United States Patent [19]

Pohl

[11] Patent Number: 4,613,194

[45] Date of Patent: Sep. 23, 1986

[54] MULTIPLE ELECTRICAL CONNECTOR AND STAGGERED MOUNTING BLOCK

[75] Inventor: Karl-Heinz Pohl, Buffalo, Minn.

[73] Assignee: The Siemon Company, Watertown, Conn.

[21] Appl. No.: 537,065

[22] Filed: Sep. 29, 1983

[51] Int. Cl.[4] ..... H01R 9/00; H01R 31/08

[52] U.S. Cl. ..... 339/19; 339/198 R

[58] Field of Search ..... 339/19, 97 R, 97 P, 339/98, 99 R, 198 R

[56] References Cited

U.S. PATENT DOCUMENTS

| | | | |
|---|---|---|---|
| 3,112,147 | 11/1963 | Pferd et al. | 339/198 R |
| 3,132,913 | 5/1964 | Pohl | 339/97 P |
| 3,151,923 | 10/1964 | Bell et al. | 339/19 |
| 4,150,867 | 4/1979 | Knickerbocker | 339/97 P |
| 4,295,703 | 10/1981 | Osborne | 339/98 |
| 4,381,880 | 5/1983 | Pohl | 339/210 M |
| 4,408,391 | 10/1983 | Pohl | 29/861 |
| 4,425,019 | 1/1984 | Pohl | 339/97 R |

FOREIGN PATENT DOCUMENTS

| | | | |
|---|---|---|---|
| 2461374 | 3/1981 | France | 339/97 R |

*Primary Examiner*—Gil Weidenfeld
*Assistant Examiner*—Gary F. Paumen
*Attorney, Agent, or Firm*—Fishman & Dionne

[57] ABSTRACT

A mounting block for solderless connectors comprises plural terminal defining conductive elements in the form of individual wire clips received by a housing and arranged in a staggered, overlapping fashion, thus conserving space. The individual terminal clips may be interconnected by means of bridge pins which are inserted into the mounting block and which thereby provide electrical contact between two wire clips.

11 Claims, 8 Drawing Figures

MULTIPLE ELECTRICAL CONNECTOR AND STAGGERED MOUNTING BLOCK

BACKGROUND OF THE INVENTION

This invention relates to the field of multiple electrical connectors and mounting blocks therefor. More particularly, this invention relates to a new and improved mounting block for wire formed solderless multiple connectors of the type shown in my prior U.S. Pat. No. 4,381,880, all of the contents of which are incorporated herein by reference.

My earlier U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in my prior U.S. Pat. No. 3,132,913 was intended as an improvement on and had several advantages over prior art clip type connectors of the type generally shown in U.S. Pat. No. 3,112,147 (of which I am a coinventor) and which are sometimes referred to in the art as "66 Type" connectors.

My subsequent U.S. Pat. No. 4,381,880 is an improvement over deficiencies in U.S. Pat. No. 3,132,913. U.S. Pat. No. 4,381,880 relates to a mounting block for solderless connectors having a retainer and a body section which defines slots for housing terminal defining conductive elements. These conductive elements are formed from wire to define linearly aligned plural loops between which wires may be inserted. The conductive elements are arranged in uniformly spaced horizontal rows and vertical columns of terminals.

Unfortunately, the evenly spaced rows and columns of terminals described in U.S. Pat. No. 4,381,880 consume a great deal of oftentimes needed space. These connectors frequently find application in the telephone art where tight sizing and space considerations are quite common. A related problem deals with the vertical columns of terminals which are actually formed from a single looped conductive element. Because of the unitary construction, the plurality of terminals formed by the adjoining loops are all electrically connected therebetween. Thus, the ability to isolate individual connections may be severely limited since a multiplicity of terminals are integrally and possibly needlessly connected.

Because of sizing and space requirement in the telephone art, it may be desirable to improve the density of connector location in a block of given size. Also, it may be desirable to increase the number of unconnected terminal sites (i.e., sites unconnected to each other).

SUMMARY OF THE INVENTION

The present invention meets the needs discussed above by providing a novel and improved solderless connector of the multiple terminal type. Solderless connectors in accordance with the present invention comprise plural terminal defining elements in the form of individual wire clips received by a housing and arranged in a staggered, overlapping fashion. The novel staggered structure of the terminal clips within the mounting block of the present invention conserve an enormous amount of space and increase the density of connector sites and the number of unconnected sites.

The individually staggered terminals are capable of electrical interconnection by utilization of bridging pins. Depending upon the number of bridging pins employed, the pins allow any two or more clips in a given staggered row of terminals to be connected. The combination of bridge pins and individual terminal clips provides the present invention with improved design flexibility in isolating specific connections.

Other advantages of the present invention will be apparent to and understood by those skilled in the art by the following detailed description and drawings.

DESCRIPTION OF THE DRAWINGS

Referring now to the drawings, wherein like elements are numbered alike in the several FIGURES.

DESCRIPTION OF THE PREFERRED EMBODIMENT

Figure 1:
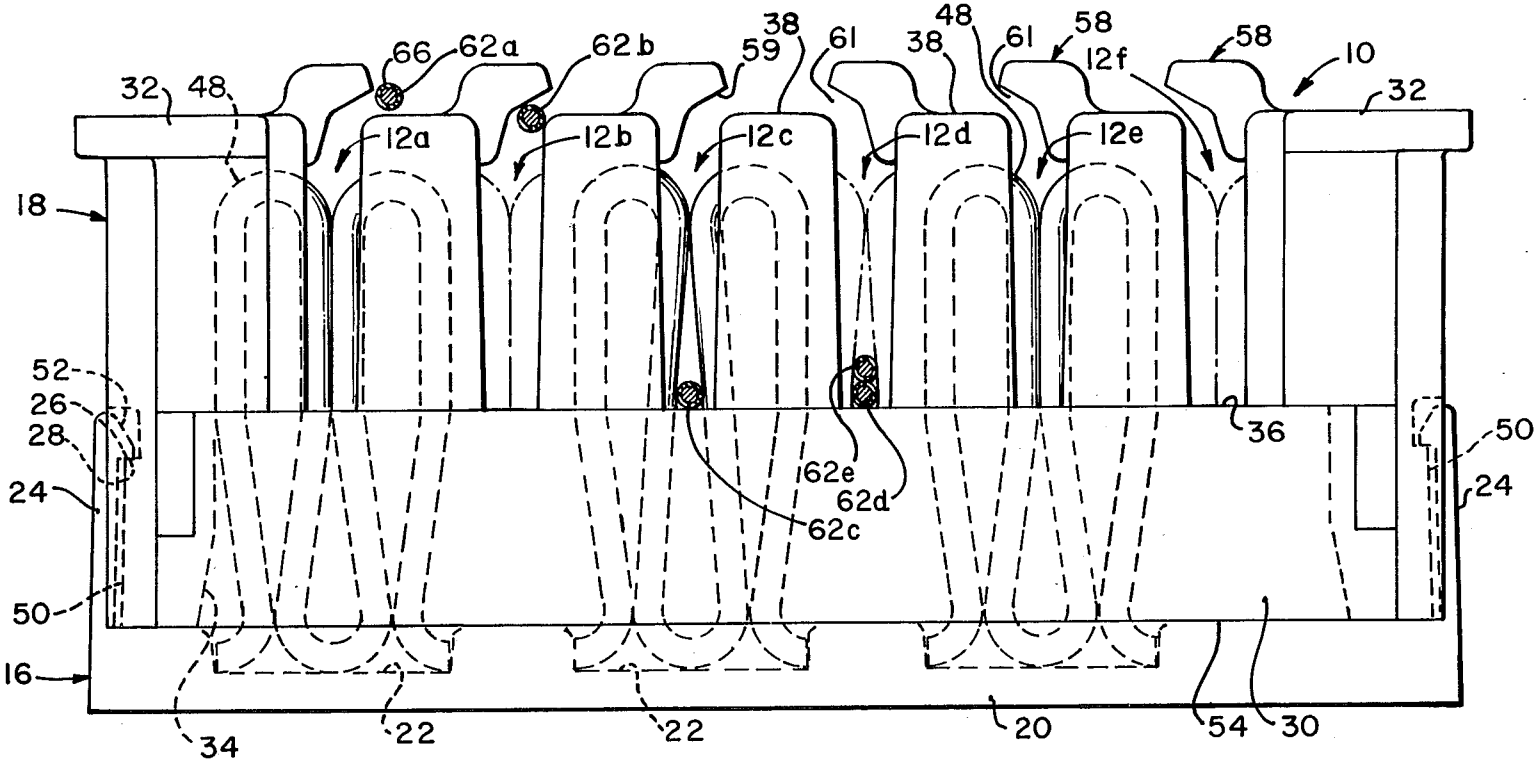
FIG. 1 is a front elevation view of the mounting block of the present invention.
Figure 2:
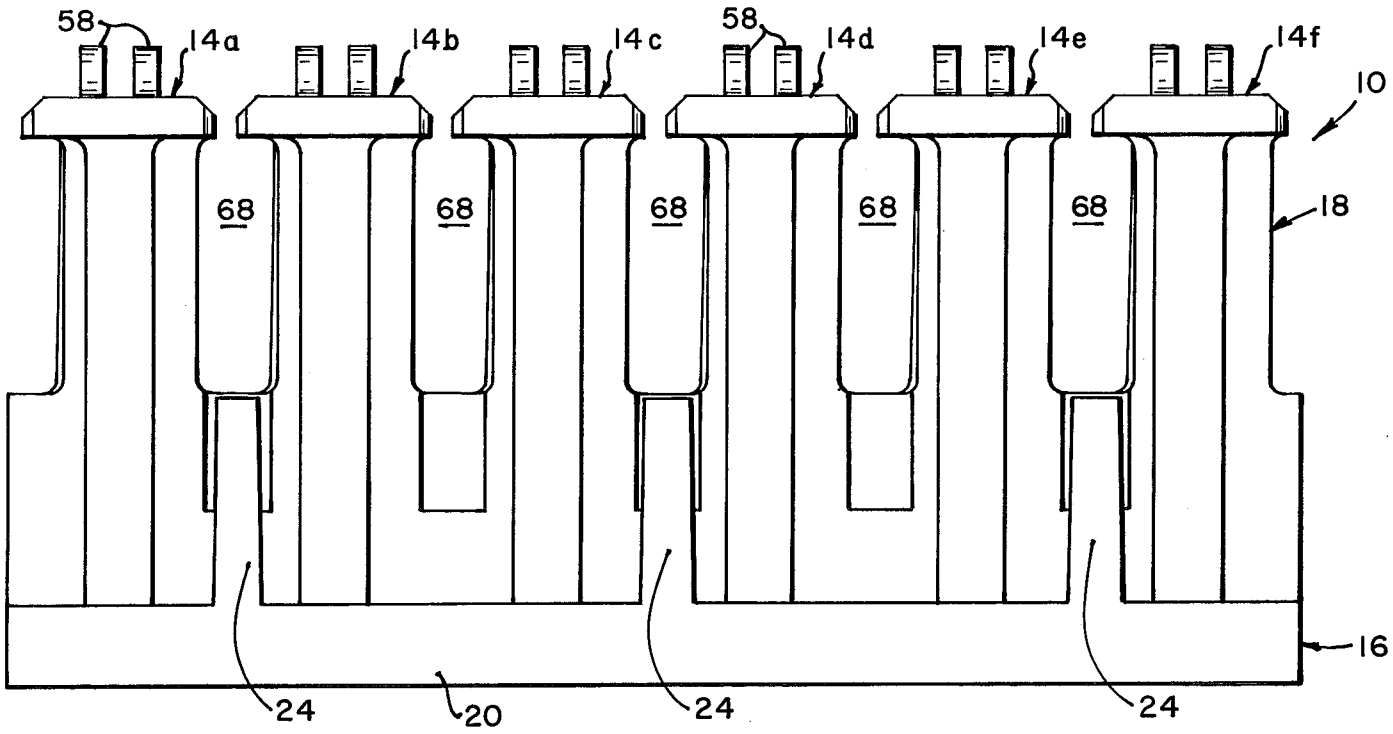
FIG. 2 is a side elevation view of the mounting block of FIG. 1.
Figure 3:
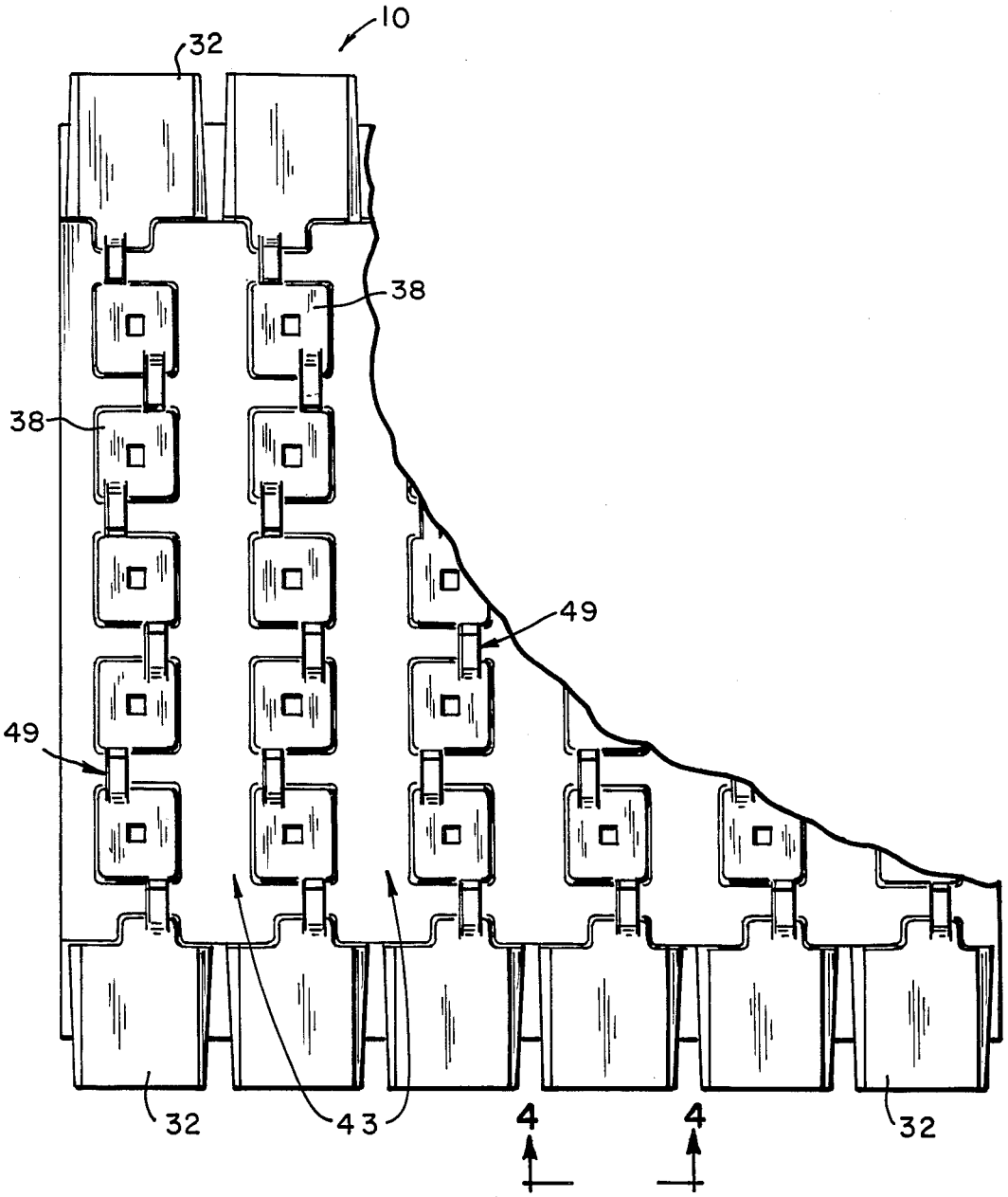
FIG. 3 is a partial top plan view of the mounting block of the present invention.

FIGS. 1, 2 and 3 show a block, generally indicated at 10, for 36 connector locations, arranged in six by six array. That is, front to back of the block there are six columns of individual connector locations, each of which has six rows of individually staggered connector locations from side to side. While the details which make up these six columns and six rows will be discussed in more detail hereinafter, the six columns are generally indicated at 12(*a*) through 12(*f*) in FIG. 1, and the six rows of staggered connector locations are generally indicated at 14(*a*) through 14(*f*) in FIG. 2. Of course, it will be understood that any desired number of rows and columns can be used, and the six by six array is merely for purposes of illustration.

Block 10 is made up of two basic interlocking parts. These two parts are a retainer 16 and a main body unit 18, both of which are molded plastic elements. For purposes of clarity and understanding, main body unit section 18 and retainer 16 are separately shown in FIGS. 1(A) and 1(B) respectively, FIGS. 1(A) and 1(B) corresponding to separate parts of the assembled unit shown in FIG. 1. Retainer 16 has a base portion 20 with a series of latitudinal (side to side) uniformly staggered or alternating slots 22 therein corresponding to the number of individual wire formed connectors to be housed in the block. Retainer 16 also has a plurality of locking arms 24 which extend upwardly from base 20 along each side of the retainer. Locking arms 24 are slightly resilient and springy, so that they can be deflected outwardly and then spring or snap back into place to lock retainer 16 and main body unit 18 together. The upper part of each locking arm 24 has an inwardly projecting locking surface or shoulder 26 to engage with and lock to a corresponding locking surface or shoulder 28 on main body unit 18.

Main body unit 18 has a main body portion 30 with a fanning strip, comprised of posts 32, running along each side, the fanning strips serving as a means of orderly entry into the block for insulated electrical wire conductors which are to be connected to solderless connectors in the block. Main body unit 18 includes, in body portion 30, a plurality of staggered latitudinal slots 34 which correspond to and are in alignment with each of the staggered latitudinal slots 22 in base 20. Body unit 18 has an internal floor or surface area 36 from which a series of inverted U-shaped bridges 38, which are integrally molded parts of main body unit 18, project. The outermost of bridges 38 are integral and coplanar with posts 32 of the fanning strip. Each bridge 38 has two overlapping passages or openings 40, each passage having an inverted U-shape in alignment with the staggered or alternating slots 22 and 34. As will be described in more detail hereinafter, the slots 22 and 34 and the passages 40 serve to house and position the rows of staggered and alternating individual wire formed solderless connectors or terminal clips to be mounted in the block. Thus, in the embodiment shown in the drawings, there are six rows of staggered slots 22 and 34, with the passages 40 of the bridges 38 in each row being aligned with respect to the slots in each row. Each bridge 38 can be considered to be made up of a pair of uprights 42,42', each upright being a mirror image of the other, and a separating member 44. The separating member 44 forms the inner walls of the two overlapping passages 40 while the uprights 42,42' form the respective outerwalls of passages 40. A pin receiving cavity 45 is recessed between uprights 42,42' and above separating member 44 while a cross piece 47 forms a protective covering on the bridge element. It will, of course, be understood that all of the bridging elements 38 are of similar construction, so only illustrative ones are marked in the drawings. As best shown in FIG. 3, the bridges are spaced apart to define (1) spaced open rows 43 in which to run conductor wires from the fanning strips and (2) spaced open columns 49 through which access is had to connect conductor wires to the connector strips housed in the block.

In assembling a block in accordance with the present invention, individual solderless connectors 48 formed from a length of conductive wire are loaded into the alternating slots 34 and bridge passages 40 of main body unit 18. Retainer 16 is then placed in position relative to the main body unit, with the staggered slots 22 in alignment with the wire strips, and the base and main body unit are then moved together to come into locking engagement. As can best be seen in FIG. 1, the innermost extension of shoulder or surface 26 on the locking arms 24 overlaps main body surfaces 50 over which the arms must slide in assembling the unit. Thus, when assembling the unit, the inclined surfaces 52 on arms 24 will be engaged by surfaces 50, whereby the locking arms 24 are cammed and deflected outwardly as retainer 16 and main body unit 18 are moved together. When the retainer and main body unit have been positioned so that the bottom 54 of body portion 30 is adjacent to the top 56 of retainer base 20, the locking arms snap inwardly with locking surfaces 26 overlapping locking surfaces 28 to complete the assembly of the block. In this manner, the wire formed connector strips are locked and retained in place in the block and are ready to receive single or plural, insulated or bare, single conductor or stranded wires to be mounted thereon.

The uniform staggering or alternating positioning of each individual solderless connector or terminal clip 48 is a very important feature of the present invention to conserve space and/or increase the density of connector sites. In the present invention, the wire formed connectors are formed into individual connectors or terminal clips 48 and then positioned in a staggered arrangement in each row so as to overlap each successive individual connector and thereby conserve space. In fact, each individual connector can overlap an adjoining connector by at least one-half the width of a connector or terminal clip 48 (i.e., one connector loop). The only limitation on the extent of overlap is that enough room must be allowed to permit the insertion of an installing tool.

The staggering of unitary connectors also imparts an enormous degree of flexibility in designing particular circuits of connectors as well as isolating very specific interconnections. This flexibility in connecting individual connectors or terminal clips is achieved by use of a bridging pin 57 to electrically connect two adjoining connectors 48. In order to effect a desired electrical link between two connectors 48, a bridging pin 57 is simply inserted into a pin receiving cavity 45 where it subsequently undergoes a frictional fit and becomes wedged between the two connectors 48. As can be best seen in FIG. 3, any two or more adjoining connectors 48 up to an entire row may be connected depending on the number of bridging pins used.

Figure 4:
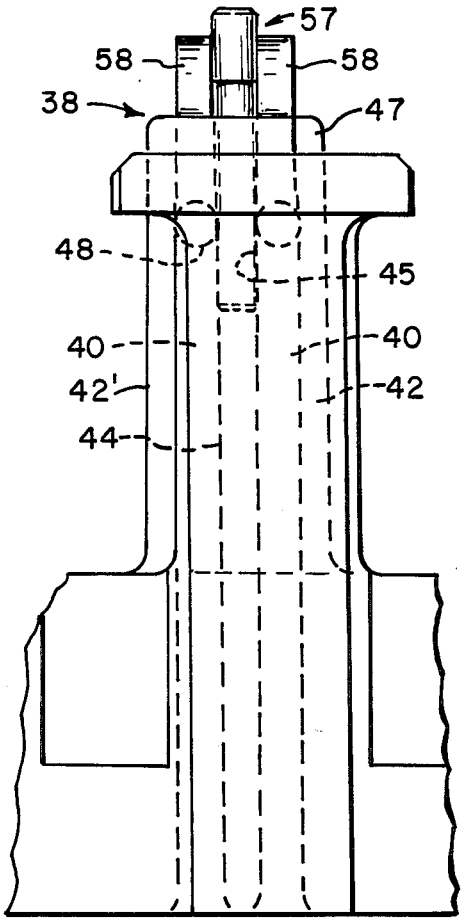
FIG. 4 is a partial sectional detail taken along line 4—4 of FIG. 3 having a bridging pin inserted therein.
Figure 5A:
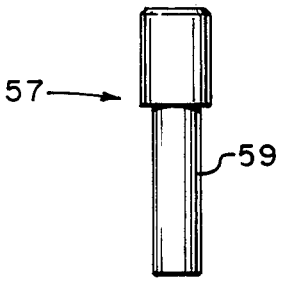
FIG. 5A is a front elevation view of a bridging pin used in accordance with the present invention.
Figure 5B:
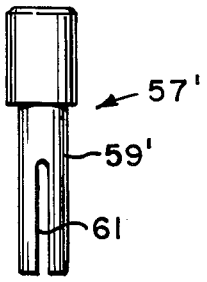
FIG. 5B is a front elevation view of another embodiment of a bridging pin used in accordance with the present invention.

Referring now to FIG. 4, an enlarged sectional view of a bridge 30 having two overlapping solderless connectors 48 therein and a bridging pin 57 mechanically wedged therebetween is shown. As thus presented, the staggered connectors 48 are electrically connected by the bridging pin 57. In FIGS. 4, and 5A, a preferred embodiment of a bridging pin 57 is shown and comprises a circular shaft portion 59 having a diameter which permits insertion and frictional fit in receiving cavity 45. The shaft 59 is integrally or otherwise attached to a larger diameter head portion which permits ease of handling by the installer. FIG. 5B shows another embodiment of a bridging pin for use in conjunction with the present invention. Bridging pin 57' has essentially the same configuration as pin 57 except for the slot 61 through the bottom portion of shaft 59'. This slot 61 provides a spring or bias action to the shaft 59' resulting in a tighter, more snug frictional fit. It is obvious to one skilled in the art that a pin having any other feasible geometric configuration will serve equally as well in establishing electrical communication between connectors 48.

Referring now to FIGS. 2 and 4, each individual wire formed connector is fully retained against movement or deflection toward any adjacent connector, since the lower loops of each wire connector are fully captured in a slot 22 and the connectors are also captured in slots 34 and the bridge passages 40 in the bridges 38. Thus, each individual wire connector is fully constrained against displacement which would create misalignment and interfere with the insertion of conductor wires. Also, the bridges shield the wire connectors and prevent short circuiting by outside objects which might fall into or otherwise come into contact with the top of the block, this protection being realized without the need for a separate cover on the block.

The present invention not only retains each row of wire-formed connectors against deflection toward an adjacent row, but also resists lateral deflection of eah connector row when a conductor is inserted therebetween. As clearly seen in FIGS. 1 and 2, each individual wire connector is snuggly captured within slots 34 of main body 18 and passages 40 of U-shaped bridges 38. Each upper loop of each connector wire is retained against outward movement by upright 42 and separating member 44 of bridges 38. The bridges 38 thus function to stiffen the upper loops of the connectors.

The lateral retention and stiffening of the upper loops or portions of the wire-formed connectors 48 within the blocks 10 serves an important purpose. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend.

Another important feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention there will be no outward expansion of the upper loop portions which would diminish their insulation stripping function. Also, the connector blocks of the present invention will reliably receive and retain multiple electrical conductors at each connector location.

Figure 1A:
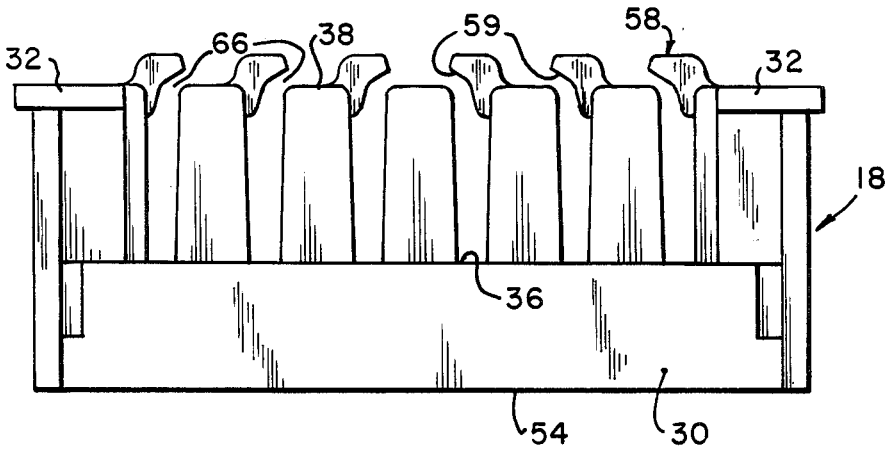
FIGS. 1(A) and 1(B) are views similar to FIG. 1 showing the retainer and main body sections, respectively, of the mounting block.
Figure 1B:
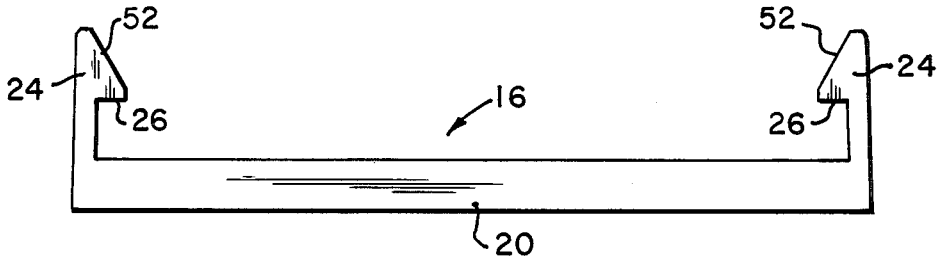

Referring now to FIGS. 1 and 1(A), boots or hooks 58 on the top portion of each bridge 38 are shown. These boots 58 extend in a hook-like manner from the top of each bridge 38. Each boot 58 is raised over or spaced above a particular connector 48. In a preferred embodiment, the tips of all boots 58 point towards the center of the connecting block to permit fanning from each side of the block. The upper portion of a boot 58 overhangs the top of an adjoining bridge 38 and forms a guide ramp 59 capable of accepting and retaining an electrical conductor in order to position it prior to connection with a clip or connector 48. Illustrative insulated conductors which have been guided into place for eventual insertion and connection to a row connector are shown at 62(*a*)–62(*e*) in FIG. 1. As can also be seen in FIG. 1(B), each boot 58 forms a diverging guide ramp 59 which serves as a retention mechanism to hold the electrical wire in place in anticipation of connection to the wire formed connector clip 48. This retention mechanism is effected due to the fact that the opening 61 between a bridge and adjacent boot is slightly narrower than the thickness of the wire (with insulated coating). Thus, the insulation covering 66 on wires 62(*a*)–62(*e*) is slightly temporarily compressed as it passes through the opening defined by the boot and adjacent bridge. Thus, the wires are retained in place. An important feature of the invention resides in the fact that a conductor to be inserted in the connector 48 can be placed in the block in anticipation of eventual connection, and will be relatively firmly retained in place until the insertion-connection operation is actually performed. Thus, the hooks or boots 58 of the bridges serve both to provide lead ins for the wires 62 and retain the wires in place in anticipation of connection to the connectors in the block. The wires to be connected to the block will, typically, be lead into the block through the spaces 68 of the fanning strips, and the wires will then be laid in the retention position discussed immediately above with respect to wires 62 of FIG. 1 in anticipation of eventual connection to the wire-formed connector strip 48.

The boots or hooks 58 offer a significant improvement over the prior art conductor retaining mechanisms such as the wing retaining elements described in U.S. Pat. No. 4,381,880. The hook-like shape and increased size of the boot 58 performs its intended wire retaining function more positively and more reliably than the wings of U.S. Pat. No. 4,381,880.

The actual mechanical and electrical connection of the conductor of a wire 62 to a connector strip will, typically, be effected by means of a wire insertion tool somewhat similar to the general type presently used for inserting wires into "66 Type" connectors of the type shown in U.S. Pat. No. 3,132,913. Mechanical and electrical connection of the conductor of wires 62(*a*)–62(*e*) to an individual terminal clip 48 is effected by forcing the wires 62(*a*)–62(*e*) downwardly between adjacent loops of wire connector 48. The wires 62(*a*)–62(*e*) will typically be forced down to floor 36. As this happens, the insulation 66 is sheared and adjacent straight sections of the loops of the connector are subsequently urged apart, and generate strong spring return forces, so that firm physical and electrical contact is established between the conductor of wires 62(*a*)–62(*e*) and the adjacent loop surfaces of the wire formed connector. As may also be seen in FIG. 1, and as also discussed above, a particularly useful feature of connectors in accordance with the present invention resides in the fact that two or more conductors may be mounted at a single station in the block. (See wires 62(*d*) and 62(*e*) in FIG. 1).

Referring to FIG. 1, a wire 62(*a*) is shown in position in the row on the right in anticipation of eventual connection to a wire formed connector strip 48. In the position as shown, conductor 62(*a*) has been led in from a fanning strip, positioned along a row 43 between adjacent rows of bridges 38, and is being retained in position by boot 58. Still referring to FIG. 1, conductor 62(*b*) is shown positioned in a retained position after it has been inserted between the boots 58 and an adjoining bridge 38. To the right of conductor 62(*b*) is conductors 62(*c*) which is shown at the bottom of a spaced row 43 after it as been inserted into the wire formed connector 48 and mechanically and electrically connected thereto. Finally, wires 62(*d*) and 62(*e*) are shown mounted in a single station as discussed above.

While a preferred embodiment has been shown and described, various modifications and substitutions may be made thereto without departing from the sprit and scope of the invention. Accordingly, it is to be understood that the present invention has been described by way of illustration and not limitation.

What is claimed is:

1. A block which houses a plurality of individual looped connector elements formed from electrically conductive stock of circular cross-section, the block including:

a retainer section;

a plurality of spaced slots arranged in rows in said retainer section, each of said retainer rows being formed of two retainer subrows with alternating ones of said retainer slots comprising each retainer subrow to form a zigzag configuration of said retainer slots in each of said retainer rows, adjacent ones of said retainer slots in each of said retainer rows overlapping one another;

a main body section;

a plurality of a spaced slots arranged in rows in said main body section, each of said main body rows being formed of two main body subrows with alternating ones of said main body slots comprising each main body subrow to form a zigzag configuration of said main body slots in each of said main body rows, adjacent ones of said main body slots in each of said main body rows overlapping one another;

a plurality of bridge elements on said main body section, said bridge elements each being in alignment with pairs of said overlapping slots in said main body section, each bridge element defining a pair of overlapping passages in registration with said main body section;

corresponding retainer slots, main body section slots and bridge element passages cooperating to define housings for a plurality of said individual looped connector elements of the type formed from electrically conductive stock of circular cross-section which are in said block;

means which electrically interconnect adjacent overlapping ones of said individual looped connector elements in each of said rows;

and means which join said retainer section to said main body section.

2. A block as in claim 1 wherein:

said main body section has a floor spaced from said retainer section; and said bridge elements extend from said floor away from said retainer section.

3. A block as in claim 1 further including:

fanning strips on the sides of said main body section; said fanning strips defining conductor entry passages in alignment with the spaces disposed between rows of said bridge elements.

4. A block as in claim 1 wherein:

said releasable joining means includes locking arms extending from said retainer section, and locking surfaces on said main body section for locking engagement with said locking arms.

5. A block as in claim 1 wherein:

said connector elements comprise a plurality of terminal clips.

6. A block as in claim 1 wherein:

each of said bridge elements is comprised of a pair of overlapping inverted U-shape passages, said passages integrally molded with the block.

7. A block as in claim 6 wherein:

said overlapping passages include:

a pair of uprights defining outerwalls;

a separating member dividing each passage and defining inner walls respectively; and a cross-piece connecting said outerwalls and defining a protective cover.

8. A block as in claim 1 wherein said electrical interconnecting means comprises a cavity centrally disposed on the upper surface of each of said bridge elements, said cavity defining an opening between said pair of overlapping passages, said cavity receiving an electrically conductive pin.

9. A block as in claim 8 wherein:

said pin is a bridging pin comprising:

a shaft portion, said shaft portion capable of insertion into said cavity and forming a friction fit therein;

a head portion attached to the top of said shaft portion.

10. A block as in claim 9 wherein said shaft portion is circular.

11. A block as in claim 10 wherein said shaft portion has a longitudinal slot on the bottom thereof, said slot imparting a bias action.

* * * * *